US005293726A

United States Patent [19]

Schick

[11] Patent Number: 5,293,726

[45] Date of Patent: Mar. 15, 1994

[54] HOLLOW COMPOSITE INTERIOR DOOR ASSEMBLY

[76] Inventor: Harold P. Schick, 7725 Glenoak Pkwy., Ft. Wayne, Ind. 46815

[21] Appl. No.: 914,967

[22] Filed: Jul. 16, 1992

[51] Int. Cl.[5] ..... E04C 2/34

[52] U.S. Cl. ..... 52/455; 52/802; 52/806; 52/821; 52/827

[58] Field of Search ..... 52/796, 797, 806, 802, 52/805, 821, 827, 455

[56] References Cited

U.S. PATENT DOCUMENTS

| | | | |
|---|---|---|---|
| 364,252 | 6/1887 | Henkle | 52/797 |
| 1,183,842 | 5/1916 | Alling | 52/802 |
| 3,305,992 | 2/1967 | Steed . | |
| 4,220,100 | 9/1980 | Palomo et al. | 52/802 |
| 4,265,067 | 5/1981 | Palmer . | |
| 4,550,540 | 11/1985 | Thorn | 52/309.4 |
| 4,579,613 | 4/1986 | Belanger . | |
| 4,635,421 | 1/1987 | Newberg . | |
| 4,720,950 | 1/1988 | Bayer . | |
| 4,811,538 | 3/1989 | Lehnert . | |
| 4,860,512 | 8/1989 | Thorn . | |
| 4,864,789 | 9/1989 | Thorn . | |
| 5,016,414 | 5/1991 | Wang . | |

*Primary Examiner*—Carl D. Friedman
*Assistant Examiner*—Christopher Kent

[57] ABSTRACT

A hollow composite interior door assembly includes a pair of sheet molding compound skins mounted on a rectangular frame. No spacer is used to provide the necessary rigidity to the structure. Rather, the skins are adhered to each other along opposed recesses crating a lattice structure framework that supports the assembly.

15 Claims, 1 Drawing Sheet

HOLLOW COMPOSITE INTERIOR DOOR ASSEMBLY

BACKGROUND OF THE INVENTION

Traditionally, door assemblies have been made entirely of wood. The wood provides the necessary strength and rigidity to enable the assembly to maintain its shape, and it gives the assembly a pleasing appearance and feel. However, wooden doors chip, crack, and become weathered. In addition, they are expensive and heavy. To overcome the problems associated with wooden doors, metal exterior doors and composite skin interior doors have been used.

Exterior metal doors with filler materials solve the problems of weathering, cracking, and chipping associated with wooden doors. The metal skin provides the necessary strength and is easily maintained. The interior of the door can be filled with an insulating material such as polyurethane or polystyrene foam to give the door the desired thermal characteristics. Although these doors are a suitable alternative to wooden doors for exterior use, they are not desirable for interior use because of cost and weight. Moldable composite skin doors are often used as an alternative to wooden doors for interior use. Moldable composite skin doors have many advantages over wooden doors. They are generally lighter than wood doors, they do not weather, chip, or crack, and they are easier to clean and maintain.

Interior door assemblies constructed of moldable composite skins are well known in the art. Since the skins lack necessary strength, a spacer, or other filler material is used to provide the door assembly with the necessary rigidity. Generally, the spacer is made of strips of wood or corrugated cardboard that are bonded to the skins. Without the spacer that is bonded to the outer skins, the door assembly would easily deflect. Although the spacer provides rigidity to the door assembly, it also increases the cost and weight of the door assembly and requires a complex manufacturing process.

SUMMARY OF THE INVENTION

In view of the above, it is an object of the present invention to provide a molded, composite skin door assembly without need for spacer material.

Another object of the present invention is to provide a composite skin door assembly of lighter weight than a composite skin door with spacers.

Another object of the present invention is to reduce the cost of composite skin door assemblies as compared to existing composite skin doors.

Still another object of the present invention is to simplify the manufacturing process for composite skin doors as compared to the present composite skin doors.

The present invention attains these objectives by providing a hollow composite door assembly having molded skins. The skins are bonded to a peripheral rectangular frame and bonded to one another along a series of corresponding, opposed recesses or grooves. By bonding the molded skins not only to the peripheral frame, but also to one another along corresponding recesses, the resulting assembly is sufficiently rigid without the need for any spacer material. Preferably the recesses act to give the appearance of a panel providing an authentically appealing door.

Other objects and advantages of the present invention will become apparent and obvious to those skilled in the art from the following description and figures.

DETAILED DESCRIPTION OF THE DRAWINGS

DETAILED DESCRIPTION OF THE PREFERRED EMBODIMENT

Figure 1:
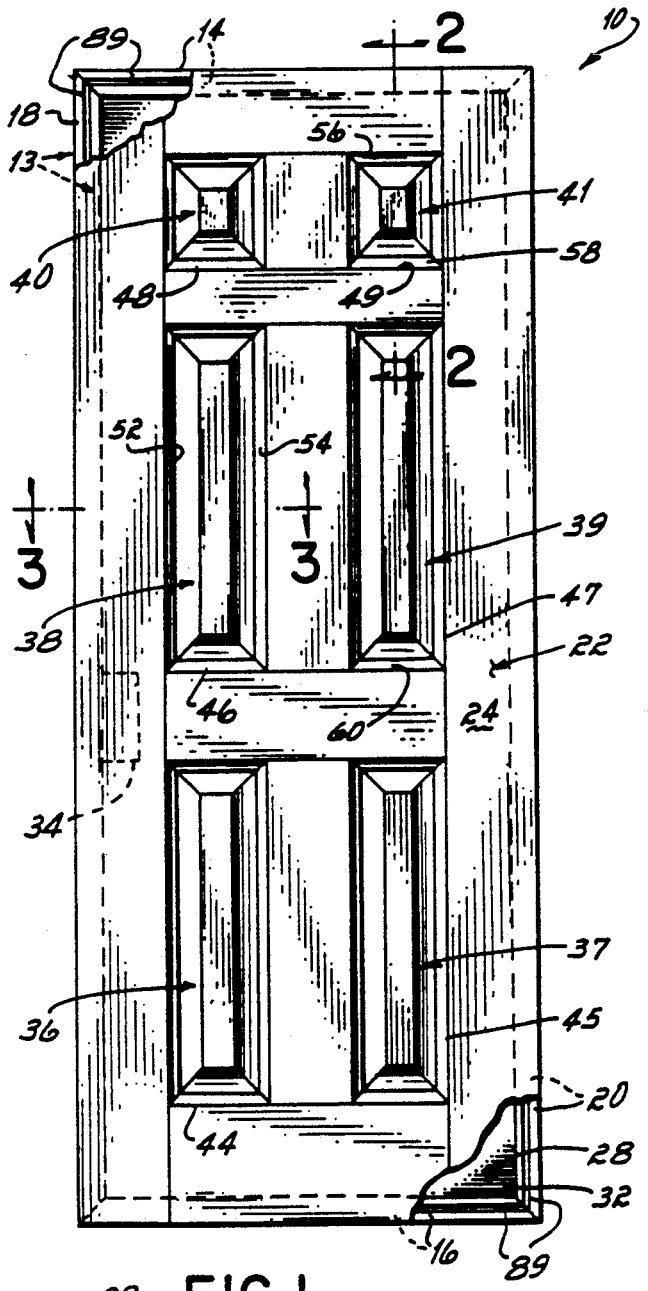
FIG. 1 is an elevation view partially broken away of a hollow, composite skin door assembly, according to the present invention, showing a 6-panel configuration.

Referring to FIG. 1 of the drawing, an interior, hollow composite skin door assembly 10, is shown. This assembly has a wooden peripheral frame 13, a molded composite front skin 22, and a mirror image, molded composite back skin 28.

Figure 2:
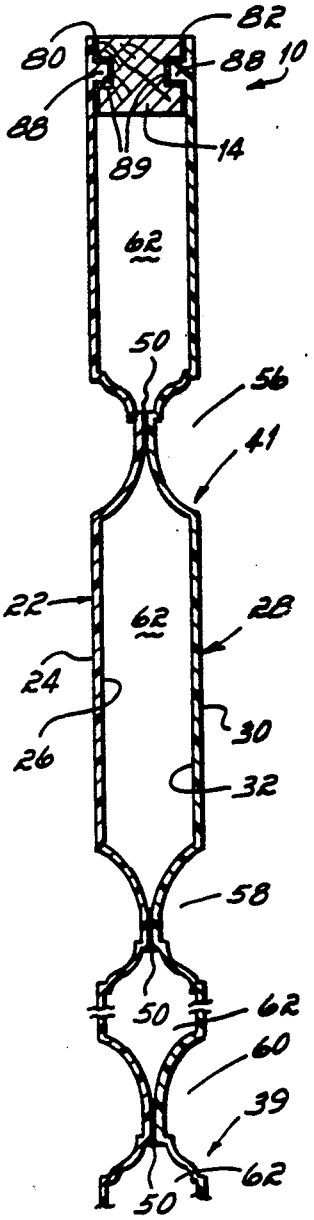
FIG. 2 is an enlarged fragmentary section view along the line 2—2 of FIG. 1.
Figure 3:
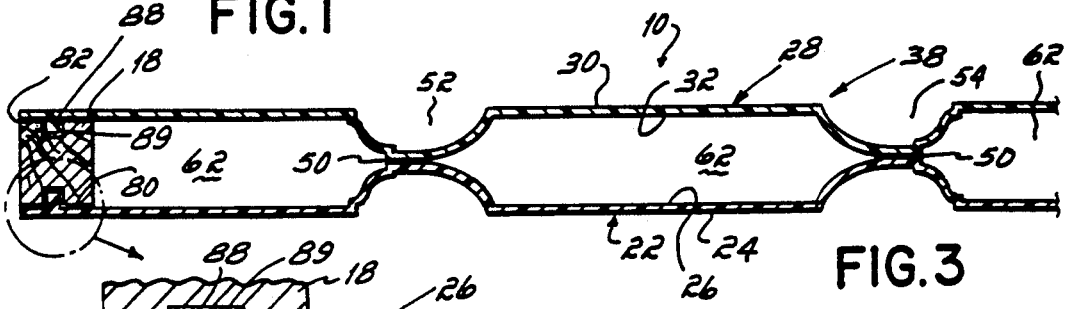
FIG. 3 is an enlarged fragmentary section view along the line 3—3 of FIG. 1.
Figure 4:
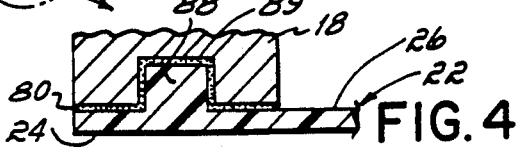
FIG. 4 is an enlargement of the portion encircled by the broken line in FIG. 3.

The wooden frame 13 is made up of a first rail 14 and second rail 16, and a first stile 18 and a second stile 20. There is an additional block of wood 34 along side the first stile 18 to enable a standard lock (not shown) to be incorporated into the final assembly. As shown in FIGS. 2, 3 and 4, the peripheral edges of skins 22, 28 are adhered to the door frame 13 to form the completed assembly 10.

Skin 22 includes an exterior side 24 and interior side 26 and likewise skin 28 includes an exterior side 30 and interior side 32 to the back skin. The exterior sides 24 and 30 of the skins are textured to simulate the look and feel of an all wood door.

Skins 22 and 28 are mirror images of each other and, except as noted, only front skin 22 is described. The composite skin 22 is molded to include an indented profile having a series of opposed rectangular recesses 44, 45, 46, 47, 48 and 49. These are shown in the drawings as rectangular in shape. But, other shapes can be employed if desired.

In the preferred embodiment, these recesses form or define a first and second lower panel 36, 37, a first and second middle panel 38, 39 and a first and second upper panel 40, 41. Each panel 36, 37, 38, 39, 40 and 41 is defined by the peripheral recesses 44, 45, 46, 47, 48 and 49. Adhesive 50 bonds skin 22 along the recesses 44–49 to the corresponding recesses in skin 28. (Recesses 52, 54, 56, 58, and 60 in skin 28 are shown in FIGS. 2 and 3.) This forms a series of hollow cavities 62 and rigid support members where the respective recesses are adhered together. This acts as a framework and provides the necessary rigidity for the door assembly. Cavities 62 are preferably unfilled void spaces.

As shown in FIGS. 2 and 3, the stiles 18 and 20 and rails 14 AND 16 are of a width so that the combined thickness of the frame 13 and adhesive layers 80 and 82 equals the depth of the recesses 52–60 of the front and rear skins 22, 28 and adhesive layer 50.

Each of the skins 22, 28 are manufactured from a moldable material such as sheet molding compound (SMC), reaction-injection-molding compound (RIM), fiberboard, or any other suitable composition known to the art. As an example, the present invention can employ an SMC having the following general material properties:

Barcol Hardness 38–46
Impact Strength 10–14 ft. lb/in
Impact Modulus 14–18 ft. lb/in
Tensile Strength 6500–8000 psi
Tensile Modulus $1.6–1.8\times10^4$
Flexural Strength 17,000–20,000 psi
Flexural Modulus $1.3–1.5\times10^4$ psi Although any composition having the above ranges of properties will be effective, the preferred material properties are:

Barcol Hardness 40
Impact Strength 11 ft. lb/in
Impact Modulus 15 ft. lb/in
Tensile Strength 7000 psi
Tensile Modulus $1.7\times10^-$ psi
Flexural Strength 19,000 psi
Flexural Modulus $1.4\times10^-$ psi To obtain these material properties in this example, the present embodiment utilizes a sheet molding polyester resin. The preferred embodiment uses a sheet molding compound of the following composition, by weight:

Unsaturated polyester resin, 60–70% in styrene 55–65 phr
Polystyrene resin, 30–40% in styrene 35–45 phr
t-butylperbenzoate (peroxy catalyst) 1 phr
Zinc stearate powder (internal release agent) 4–6 phr
Ground limestone, 4–7$\mu$ (filler) 155–165 phr
Magnesium hydroxide (thickener) 2–5 phr
Glass fiber, 1 inch chopped (reinforcement) 65–75 phr
Pigment 0–6 phr A skin molded from this composition having a thickness of 0.06–0.13 inch will have the required properties. It should be noted that a wide variety of fiberboard and polymeric materials can be used in this application.

In assembling the door, a hot melt urethane adhesive is applied to the periphery of the skin 22 and a thermoset urethane adhesive is applied to the interior surfaces 26 of skin 22 at all of the recesses. The rails and stiles are then adhered to the periphery of the front skin 22. The interior surfaces 26 and 32 of each skin includes a series of one inch tabs 88 along the periphery (three on the top and bottom and six along each side). When the rails and stiles are in position, the tabs rest in grooves 89 in the stiles and rails so that the frame 13 is flush with the edge of the skin (see FIG. 4). Hot melt urethane adhesive is then applied to the exposed rear side of the wooden frame. The interior side surface 32 of the back skin 28 is then adhered to the frame 13 by adhesive layer 82. Simultaneously, the opposed recesses on the skins 22 and 28 are adhered together by adhesive layer 50. Tabs 88 on the rear skin 24 are also located in grooves in the stiles and rails to properly fix the outer skin in position.

The thickness of the wooden frame 13, the applied adhesive 58, the skins 22, 28, and the depth of the recesses 44–49 are designed to ensure that the skins will be bonded at the recesses. The thickness of the wooden frame 13 plus adhesive layers 80 and 82 is equal to the thickness of a front recess, a rear recess and adhesive layer 50. Adhesive layer 50 is preferably between about 0.01 inch to about 0.02 inch. The thickness of adhesive necessary to secure the skins 22, 28 to the frame 13 is about 0.001 inch.

This construction has many different advantages. When a recessed portion of the front skin is adhered to the corresponding recessed portion of the back skin, the combined structure provides a rigid support or internal frame structure that keeps both skins from flexing. This can be used with a two panel up to and exceeding a six panel door. since the thickness of the skins remains approximately constant throughout (even at the recess), this adds little weight to the door assembly.

Further, the tabs in the skin (which can be replaced by a rib running along the edges) properly locates the frame members as well as the front and rear skins relative to each other.

Since the frame is wood, the door can be hung in a typical fashion and the edges can be planed to fit the opening, if necessary.

Further, this construction can be used with a variety of different outer skins including pressed fiberboard, reaction injection mold skins and sheet molding compound.

This has been a description of the present invention and how to practice that invention. However, the invention should be defined only in terms of the following claims wherein:

What I claim is:

1. A door assembly, comprising:

a front skin and a back skin, said front skin and said back skin having corresponding, opposed recesses, said opposed recesses establishing a plurality of panels, a plurality of hollow cavities surrounding said panels, a peripheral rectangular frame extending only around a perimeter of said door, said front skin and said back skin fixed to said frame and said front skin fixed directly to said back skin along said opposed recesses thereby establishing an internal frame structure to provide strength and rigidity to said door assembly.

2. The door assembly of claim 1 wherein said skins are formed from moldable composite materials, and wherein said skins are continuous skins establishing the entire front and back surfaces of said door assembly.

3. The door assembly of claim 2 wherein said moldable composite material is selected from the group consisting of sheet molding compound, reaction-injection-molding and fiberboard.

4. The door assembly of claim 3 wherein said moldable composite material is sheet molding compound.

5. The door assembly of claim 3 wherein said skins are of a thickness from about 0.06 inch to about 0.3 inch.

6. The door assembly of claim 1 wherein said rectangular frame is composed of wood.

7. The door assembly of claim 6 having means for positioning said front skin and said back skin onto said frame to align said recesses.

8. The door assembly of claim 7 wherein said positioning means comprises a groove in both front and back sides of said frame and a plurality of tabs on each of said front skin and said back skin whereby said grooves and said tabs interlock, positioning said skins on said frame.

9. The door assembly of claim 1 with at least two of said opposed recesses forming two of said panels.

10. The door assembly of claim 1 with at least four of said opposed recesses forming four of said panels.

11. The door assembly of claim 1 with at least six of said opposed recesses forming six of said panels.

12. The door assembly of claim 1 wherein said frame is of a thickness sufficient to maintain a gap between said front skin and said back skin at said recesses.

13. The door assembly of claim 12 wherein said gap is from about 0.01 inch to about 0.02 inch.

14. The door assembly of claim 13 wherein said front skin and said back skin are fixed to said frame, and said front skin is fixed to said back skin along said opposed recesses by adhesive.

15. A door assembly, comprising:

a sheet molding compound front continuous skin and a sheet molding compound back continuous skin, said front skin and said back skin having corresponding, opposed recesses, said opposed recesses establishing a plurality of panels, and a plurality of hollow cavities surrounding said panels.

a pair of horizontal rails and vertical styles constructed of wood, means for connecting said rails and said styles to establish a peripheral rectangular frame for said door assembly, said frame extending only around a perimeter of said door assembly, means for positioning said front skin and said back skin onto said frame to align said opposed recesses, said frame of a thickness sufficient to maintain a gap between said front skin and said back skin at said opposed recesses, said front skin and said back skin adhered to said frame and said front skin adhered directly to said back skin along said opposed recesses thereby establishing a closed, rigid assembly with a plurality of hollow cavities between said skins.

* * * * *